US008944251B1

(12) United States Patent
Yecies Heller et al.

(10) Patent No.: US 8,944,251 B1
(45) Date of Patent: Feb. 3, 2015

(54) PACKAGING DEVICE

(71) Applicant: UCan Products, Inc., Menlo Park, CA (US)

(72) Inventors: Carolyn Yecies Heller, Menlo Park, CA (US); Branko Lukic, Menlo Park, CA (US); Anne Morrissey, Menlo Park, CA (US); Steven Takayama, Menlo Park, CA (US)

( * ) Notice: Subject to any disclaimer, the term of this patent is extended or adjusted under 35 U.S.C. 154(b) by 0 days.

(21) Appl. No.: 14/175,860

(22) Filed: Feb. 7, 2014

Related U.S. Application Data

(60) Provisional application No. 61/762,701, filed on Feb. 8, 2013.

(51) Int. Cl.
*A47K 10/42* (2006.01)
*B65D 85/16* (2006.01)

(52) U.S. Cl.
CPC ..... *B65D 85/16* (2013.01)
USPC ..... 206/494; 221/305

(58) Field of Classification Search
CPC ..... B65D 83/0852; A47K 10/421
USPC ..... 206/494; 221/33, 63, 305
See application file for complete search history.

(56) References Cited

U.S. PATENT DOCUMENTS

| | | | | | |
|---|---|---|---|---|---|
| 1,598,235 | A | * | 8/1926 | Barbieri | 229/110 |
| 1,662,980 | A | * | 3/1928 | Palmer | 206/494 |
| 2,085,882 | A | * | 7/1937 | Wandel | 221/63 |
| 2,206,838 | A | * | 7/1940 | Emerson | 221/62 |
| 2,335,914 | A | * | 12/1943 | Buttery | 221/63 |
| 2,624,456 | A | * | 1/1953 | Taylor | 221/63 |
| 2,909,277 | A | * | 10/1959 | Thiers et al. | 206/409 |
| 3,195,772 | A | * | 7/1965 | Buttery | 221/33 |
| 3,424,367 | A | * | 1/1969 | Lesinski et al. | 229/118 |
| 3,624,791 | A | * | 11/1971 | Taub | 221/59 |
| 3,669,307 | A | * | 6/1972 | Pfund et al. | 221/63 |
| 3,880,342 | A | * | 4/1975 | Longo, Jr. | 229/115 |
| 3,982,659 | A | * | 9/1976 | Ross | 221/63 |
| 3,986,479 | A | * | 10/1976 | Bonk | 118/506 |
| 3,994,417 | A | * | 11/1976 | Boedecker | 221/48 |
| 4,139,114 | A | * | 2/1979 | Long et al. | 220/23.4 |
| 4,181,218 | A | * | 1/1980 | Cox | 206/205 |
| 4,181,225 | A | * | 1/1980 | Spiegelberg | 206/494 |
| 4,200,200 | A | * | 4/1980 | Hein et al. | 221/48 |
| 4,863,064 | A | * | 9/1989 | Dailey, III | 221/48 |
| 5,577,612 | A | * | 11/1996 | Chesson et al. | 206/494 |
| 6,585,130 | B2 | * | 7/2003 | Turbett et al. | 221/45 |
| 7,007,801 | B2 | * | 3/2006 | Mangold et al. | 206/494 |
| 7,275,657 | B2 | * | 10/2007 | Geyer | 221/52 |
| 7,568,594 | B2 | * | 8/2009 | Long | 221/63 |

(Continued)

*Primary Examiner* — Steven A. Reynolds
*Assistant Examiner* — King M Chu
(74) *Attorney, Agent, or Firm* — Hickman Palermo Truong Becker Bingham Wong LLP

(57) ABSTRACT

A packaging device, comprises a top wall formed as an arcuate isosceles triangle; a bottom wall formed as the arcuate isosceles triangle; an elongated generally rectangular planar main wall comprising a first longitudinal edge joined perpendicularly to the top wall along a first perimeter of the top wall, and a second longitudinal edge joined perpendicularly to the bottom wall along a second perimeter of the bottom wall, wherein the top wall and bottom wall are spaced apart by a length of the main wall; a first lateral edge joined to a second lateral edge at an acute angle and forming a continuous edge and defining an arcuate spine opposite and spaced apart from the continuous edge; wherein the top wall, bottom wall, and main wall define an interior cavity.

19 Claims, 3 Drawing Sheets

(56) References Cited

U.S. PATENT DOCUMENTS

| | | | | |
|---|---|---|---|---|
| 8,074,801 | B2 * | 12/2011 | Slayton et al. | 206/440 |
| 8,408,419 | B2 * | 4/2013 | Rippl et al. | 221/305 |
| 8,534,496 | B2 * | 9/2013 | Crabill | 221/305 |
| 2006/0231564 | A1 * | 10/2006 | Goddard et al. | 221/63 |
| 2006/0273099 | A1 * | 12/2006 | Abbosh et al. | 221/33 |
| 2009/0194555 | A1 * | 8/2009 | Hoefing et al. | 221/63 |
| 2014/0076915 | A1 * | 3/2014 | Becherer et al. | 221/33 |

* cited by examiner

PACKAGING DEVICE

BENEFIT CLAIM

This application claims benefit of Provisional Application No. 61/762,701, filed Feb. 8, 2013, the entire contents of which is hereby incorporated by reference as if fully set forth herein, under 35 U.S.C. §119(e).

TECHNICAL FIELD

The present disclosure generally relates to packaging for containing and holding bags and other objects or materials.

BACKGROUND

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

Manufacturers of trash bags and other similar products typically package their products in rectangular boxes. Such rectangular boxes typically cannot be assembled before shipping or, if they are assembled prior to shipping, they must be packaged in a padded box so they are not damaged or crushed during transit.

There is a need for a packaging solution that is easier to ship. Manufacturers would also benefit by a packaging solution that is also cost-efficient and visually appealing to customers.

SUMMARY OF THE INVENTION

The invention may be summarized based upon the appended claims.

Figure 1A:
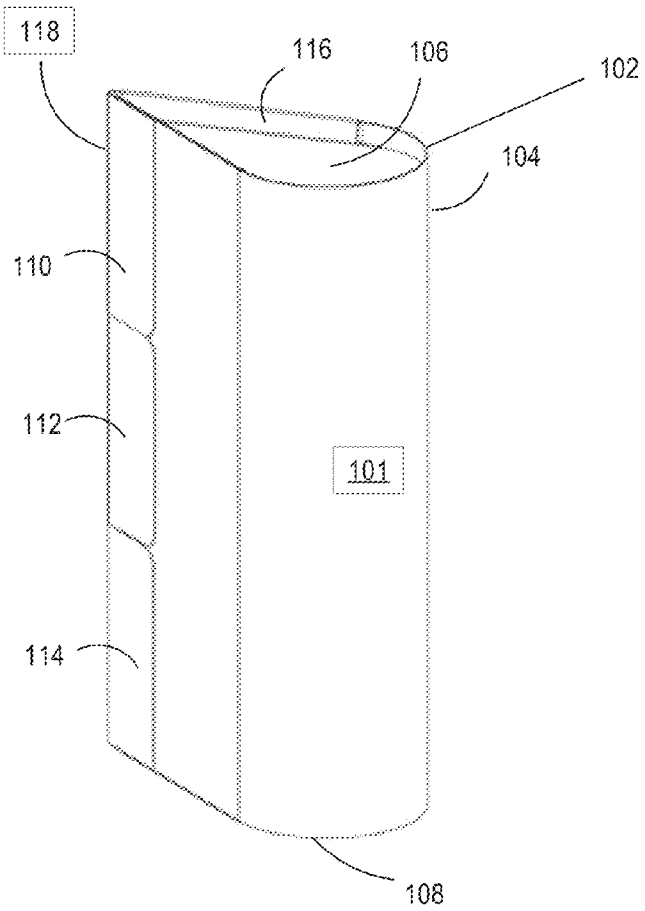
FIG. 1A is a perspective view of a packaging device.

The drawings are not rendered to scale.

DETAILED DESCRIPTION

In the following description, for the purposes of explanation, numerous specific details are set forth in order to provide a thorough understanding of the present invention. It will be apparent, however, that the present invention may be practiced without these specific details. In other instances, well-known structures and devices are shown in block diagram form in order to avoid unnecessarily obscuring the present invention.

1.0 Overview

In an embodiment, a packaging device, comprises a top wall formed as an arcuate isosceles triangle; a bottom wall formed as the arcuate isosceles triangle; an elongated generally rectangular planar main wall comprising a first longitudinal edge joined perpendicularly to the top wall along a first perimeter of the top wall, and a second longitudinal edge joined perpendicularly to the bottom wall along a second perimeter of the bottom wall, wherein the top wall and bottom wall are spaced apart by a length of the main wall; a first lateral edge joined to a second lateral edge at an acute angle and forming a continuous edge and defining an arcuate spine opposite and spaced apart from the continuous edge; wherein the top wall, bottom wall, and main wall define an interior cavity.

In an embodiment, the main wall further comprises an opening into the interior cavity, and a flap covering the opening and extending outwardly from the main wall. In an embodiment, the flap is temporarily affixed to an item in the interior cavity. In an embodiment, the flap comprises two or more perforated edges.

In an embodiment, there are one or more tabs extending from the first lateral edge and affixed over the second lateral edge. In an embodiment, there are one or more upstanding lips extending from one or more of the top wall and the bottom wall. In an embodiment, a height of the main wall in an upright position exceeds a width of the packaging device.

In an embodiment, the packaging device further comprises two tabs extending from the first lateral edge and affixed over the second lateral edge; an opening, in the main wall, into an interior of the packaging device; a flap, between the two tabs, covering the opening and extending outwardly from the main wall.

In various embodiments, the packaging device comprises a single sheet of material, comprises a single sheet of paper or cardstock, and comprises one or more bags in the interior cavity.

One embodiment comprises a sheet capable of formation into a packaging device, with an elongated generally rectangular planar main wall; a top wall for the packaging device that is formed as an arcuate isosceles triangle and is formed integrally with a first longitudinal edge of the main wall; a bottom wall for the packaging device that is formed as the arcuate isosceles triangle and is formed integrally with a second longitudinal edge of the main wall opposite the first longitudinal edge.

In an embodiment, the sheet has one or more tabs extending laterally outwardly from a first lateral edge of the main wall; one or more slots in the main wall, wherein the slots are spaced apart from the tabs, are aligned with the tabs, and are configured to snugly receive the tabs for forming the sheet into the packaging device having an arcuate spine and defining an interior cavity.

The sheet may have a flap extending laterally outwardly from a first lateral edge of the main wall, and a hole in the main wall aligned with the flap and located near a second lateral edge of the main wall that is opposite the first lateral edge. In an embodiment, the hole is spaced apart from the second lateral edge and is aligned with a fold line defining a continuous edge of the packaging device when the main wall is curved according to an arc such that the flap overlies the hole.

In an embodiment, the flap is formed between first and second tabs extending laterally outwardly from a first lateral edge of the main wall; the sheet further comprising one or more slots in the main wall, wherein the slots are spaced apart from the tabs, are aligned with the tabs, and are configured to snugly receive the tabs for forming the sheet into the packaging device having an arcuate spine and defining an interior cavity.

In an embodiment, a bag packaging device comprises a top wall formed as an arcuate isosceles triangle; a bottom wall formed as the arcuate isosceles triangle; an elongated generally rectangular planar main wall comprising a first longitudinal edge joined perpendicularly to the top wall along a first perimeter of the top wall, and a second longitudinal edge joined perpendicularly to the bottom wall along a second perimeter of the bottom wall, wherein the top wall and bottom wall are spaced apart by a length of the main wall; a first lateral edge joined to a second lateral edge at an acute angle and forming a continuous edge and defining an arcuate spine opposite and spaced apart from the continuous edge; wherein the top wall, bottom wall, and main wall define an interior cavity; a plurality of bags within the interior cavity.

The bag packaging device may have a main wall with an opening into the interior cavity, and a flap covering the opening and extending outwardly from the main wall. In an embodiment, the flap is temporarily affixed to one of the bags in the interior cavity.

In an embodiment, a packaging device comprises a closed box that appears in cross section as an arcuate isosceles triangle, or teardrop shape, having a curved arcuate end and a pointed end, in which the packaging device is wider at the curved end than at the pointed end, and a teardrop-shaped base capable of supporting the packaging device in an upright position. The packaging device may contain bags, for example, rolls or stacks or other assemblies of trash bags or compost bags, or other goods or items.

In an embodiment, a line along the diameter of the top and/or base of the packaging is perforated, scribed or otherwise differs in some other manner from the remaining portion of the base and packaging such that when the packaging is compressed, the base and top are caused to be folded along the lines.

In an embodiment, the packaging comprises a flap that covers an opening through which the contents may be accessed. The flap is affixed using adhesive or mechanical means to contents of the packaging such that when the flap is folded back the contents are caused to be pulled out through the opening.

In an embodiment, the packaging may be formed from a single sheet of material that is cut in a specified shape in a manufacturing process and folded along one or more lines and joined at one or more locations. The single sheet of material may also be cut along one or more lines during the assembly of the packaging. One or more locations of the single sheet of material may be joined using adhesive or mechanical means. For example, a portion of the material may be fastened to another portion by being tucked into a slot located on the other portion.

A package as described herein provides many benefits over conventional packaging approaches. The packaging may be less likely to show signs of wear and tear occurring during shipping than other conventional types of packaging. The rounded shape of the packaging and the tops and bases, which are foldable in the manner described above, may cause the packaging to fold in a manner that does not cause visible lines or permanent damage to the structure of the packaging.

Such a package may also use less material than conventional packaging approaches, thus providing a more cost-efficient and more environmentally friendly solution. The spine of the packaging may be rounded resulting in a more ergonomic shape than conventional packaging. Finally, the packaging may have a unique shape that is more visually appealing to customers.

2.0 Example Mechanical Configuration

An example packaging device is now described with reference to the examples shown in the drawings.

FIG. 1A is a perspective view of a packaging device. In an embodiment, a packaging device 102 comprises a top wall 106, a bottom wall 108 spaced apart longitudinally by an outer wall 101. The outer wall 101 comprises first and second relatively straight sides or edges terminating in a continuous edge 118 that is spaced apart from an arcuate spine 104 formed by curving the first edge and second edge to join the edges to one another at the continuous edge. In this configuration, top wall 106 and bottom wall 108 each have a cross section formed as an arcuate isosceles triangle or teardrop having two generally straight edges of equal length terminating at first ends at an acute angle and joined at second ends by an arc or curve. In particular, in an embodiment, the outer wall 101 comprises first and second longitudinal edges that are joined, respectively, perpendicularly to the top wall 106 and bottom wall 108, which are positioned at opposite ends of the outer wall 101. The outer wall 101 is formed in an arcuate shape such that lateral edges of the outer wall meet at an acute angle forming the edge 118. In this configuration the packaging device 102 may be supported by base 108 or by top 106 when standing in an upright position.

Top wall 106 may comprise an upstanding lip 116 that extends beyond top 106 and the lip may be integral with the outer wall. There may also be a lip extending beyond the base 108. When the packaging device is supported by top 106 or base 108, lip 116 or the lip extending beyond base 108 makes contact with the surface upon which the packaging device rests. In other embodiments, the packaging device may not have lips which extend beyond the base and top of the packaging device and the base and top of the packaging device may make direct contact with the surface upon which the packaging device rests.

A benefit of the present configuration is that packaging device 102 may be held comfortably in a human hand by grasping spine 104 of the packaging device, so that the rounded arcuate shape of the spine is adjacent to the palm. The rounded arc-like shape provides an ergonomic means for holding the packaging device.

In an embodiment, package 102 further comprises first and second tabs 110, 114 and a flap 112 each formed integrally with or joined to the outer wall 101. In an embodiment, flap 112 is bordered by tab 110 on one side and tab 114 on the other side. Tabs 110, 114 may be formed by folding at edge 118 to overlap a portion of the outer wall 101 that is adjacent to edge 118, and similarly the flap 112 may also partially overlap a portion of the outer wall. Flap 112 may be separated from tab 110 and tab 114 by cut lines at the borders between the flap and the tabs. The borders between the flap and tabs may be perforated or otherwise marked for ease in tearing or cutting along the borders. In an embodiment, flap 112 covers a corresponding opening in outer wall 101 through which the contents of the packaging may be removed, and the flap can be pulled back to reveal the opening covered by the flap and to gain access to the interior of the package or its contents.

Figure 1B:
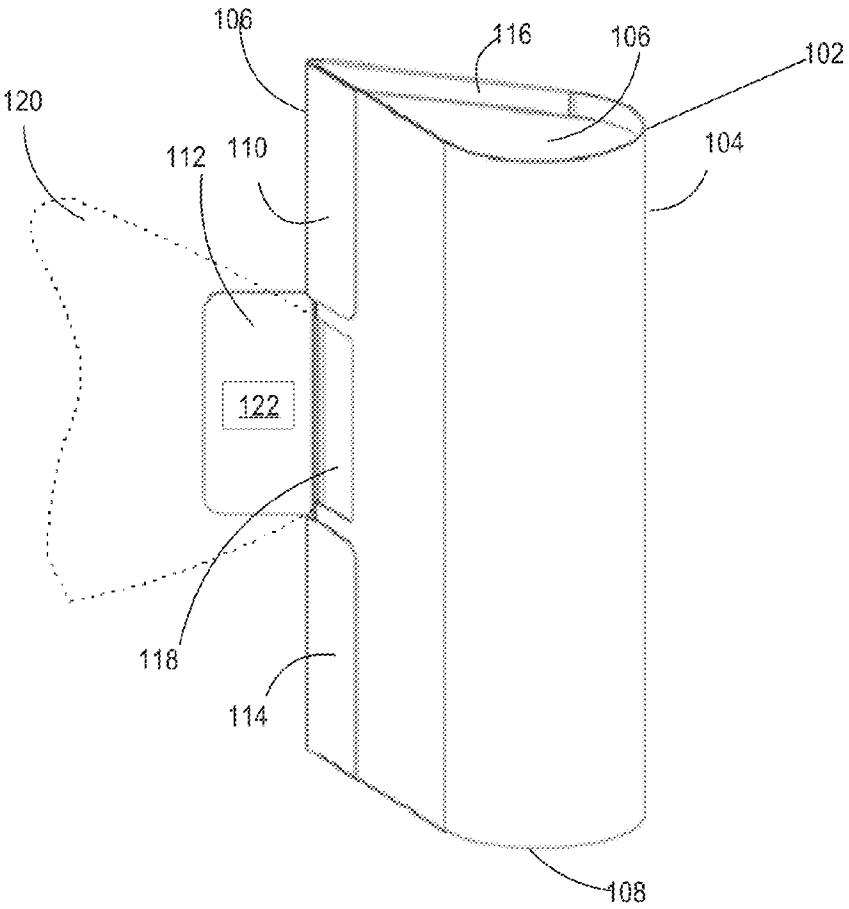
FIG. 1B is a perspective view of the packaging device of FIG. 1A, where the flap is in the open position.

FIG. 1B is a perspective view of the packaging device of FIG. 1A, where the flap is in the open position. In the view of FIG. 1B, flap 112 may be seen as adjacent to opening 118 so that in the closed position of FIG. 1A the flap covers the opening, whereas when flap 112 is pulled back as in FIG. 1B the contents of the packaging are accessible through the opening. In an embodiment, the packaging device contains a roll, stack, bundle or other assembly of multiple bags, such as refuse bags of polyethylene, polypropylene, or other materials. In the view of FIG. 1B, bag 120 as indicated by a phantom line for clarity is an example of contents that may be stored in the packaging device. In embodiment, an inner face 122 of the flap 112 is affixed to a first item that is inside the packaging device, such as bag 120, such that when the flap is pulled back, the affixed content is caused to be partly withdrawn from the packaging. Flap 120 may be affixed to an item of the contents using an adhesive, or the flap and content may be joined by other mechanical means.

In FIG. 1A, 1B, flap 112 is adjacent edge 118 of the pointed end of the packaging device 102, so that a non-perforated part of the flap is at the edge. In another embodiment, the flap and a corresponding opening through which the content is accessible may be at a different location of the packaging device 102, such as along the spine of the packaging device, the top of the packaging device, or somewhere in the region between the spine and the pointed edge.

In an embodiment, flap 120 is capable of securement in the closed position. In an embodiment, a portion of flap 120 is a tab that fits snugly within a corresponding slot in the outer wall 101 of the packaging device 102, thereby holding the flap in a closed position. In another embodiment, a portion of flap 120 is affixed by adhesive to a portion of the outer wall 101 of the packaging device 102.

In an embodiment, in the views of FIG. 1A, 1B packaging device 102 has a height in an upright position that is greater than its width or length. In other embodiments, the relative dimensions of the packaging device may differ. For example, the packaging device may have a length and width that is greater than its height when the packaging device stands upright. In addition, the drawing views herein are not to scale and do not represent any required proportions, ratios or dimensions.

The packaging device 102 may be comprised, at least partially, of paper, cardboard, cardstock, plastics, wood, metal, or other sheet material, in various embodiments. The material may be flexible material that is capable of bending or folding. In an embodiment, the packaging device 102 is manufactured or assembled by bending and/or cutting a single sheet of material along various lines.

Figure 2:
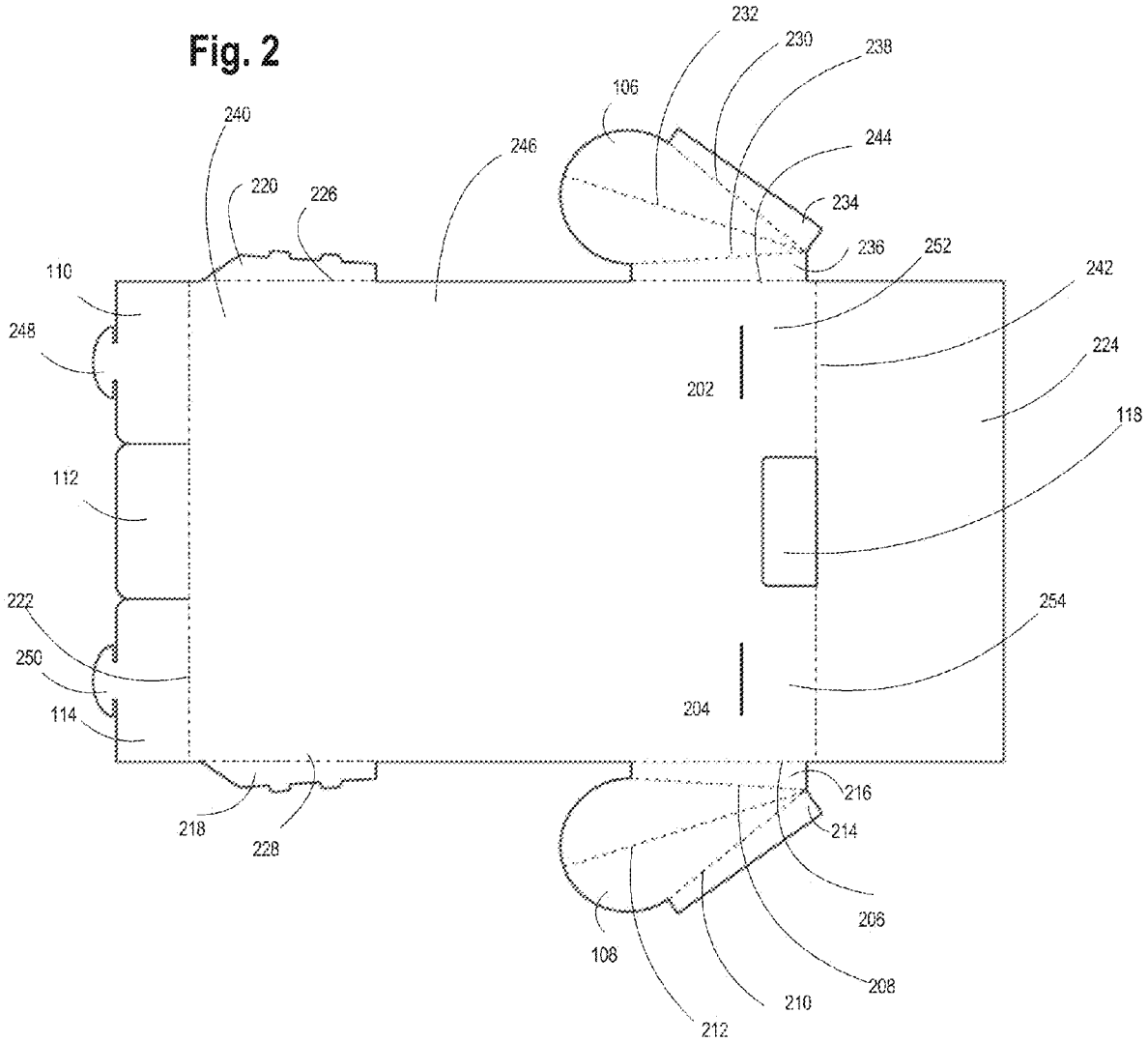
FIG. 2 illustrates a sheet of material which may be assembled to form a packaging device.

FIG. 2 illustrates a sheet of material which may be assembled to form a packaging device. In an embodiment, a main portion 246 is formed generally as an elongated rectangle. Longitudinal edges of the main portion 246 comprise outwardly protruding tabs 218, 220 that are configured to snugly fit within corresponding slots in other portions as further described below. In an embodiment, a generally rectangular hole 118 is formed in the main portion to permit contents of the assembled package to protrude through or to be obtained. A first lateral end of the main portion 246 comprises outwardly extending tabs 248, 250 with rounded extended portions that are formed to fit snugly within and lock into corresponding slots 202, 204 in the main portion when the main portion is folded as described further below.

Main portion 246 further comprises integrally formed top wall 106 and bottom wall 108 having a generally arcuate isosceles triangular shape when seen in the plan view of FIG. 2. Walls 106, 108 may be bounded by elongated portions 214, 216, 234, 236 that facilitate securement to edges of the main portion 246 as further described below; for example, the elongated portions may form gluing surfaces for the application of adhesive to hold the folded, formed package in a closed and completed assembly.

The packaging device 102 may be assembled by performing one or more of the following steps: Main portion 246 may be bent and the lateral edges brought together so that a first end region 240 lies over an opposite second end region 224 and line 222 lies over line 242. The pointed edge 118 of the packaging device may be formed at the location where lines 222 and line 242 overlap. The curve of main portion 246 that occurs when its lateral edges are brought together forms the curved spine 104 of the packaging device 102.

The rounded extended portions of tabs 110, 114, and tabs 248, 250, may be inserted into slots 202, 204. Flap 112 may lie over opening 118, and flaps 110, 114 may lie over regions 252, 254, respectively, for securement with adhesive or other means. Bending the main portion 246 in such a configuration results in a packaging device 102 that has an arcuate isosceles triangle profile, or teardrop shaped base and top. The insertion of the extended portions of tabs 110, 114 into slots 202, 204 may secure the curved teardrop shape of the packaging device. In another embodiment, the shape is secured in some other manner, such as by adhesively joining region 240 and region 224.

Top wall 106 of the sheet of material may be bent at lines 244, 238, 230 to form the lip 116 and top of the packaging device. Top wall 106 and bottom wall 108 may be folded after the ends of the main portion 246 have been brought together to form the teardrop shape. The main portion 246 also may be folded at line 238 so that portion 236 overlaps a portion of main portion 246, where the portion is located on the inner wall of the packaging device after it has been folded into the teardrop shape. The overlapping portion thus forms lip 116 at the top of the packaging device. The main portion 246 also may be folded at line 230 so that portion 234 also overlaps a sub-portion of the main portion 246 which is a different location on the inner wall of the packaging device 102 after it has been folded into the teardrop shape. Portions 234, 236 form a portion of a lip at the base or top of the packaging device. After folding, the edges of top wall 106 meet the entire circumference of the packaging device's tear-drop shaped wall. Adhesive may be applied so that portions 234, 236 are joined to corresponding parts of main portion 246.

Base wall 108 may be assembled similar to the top wall 106 discussed above. Portion 108 may be bent at lines 206, 208, 210 to form the lip and base of the packaging device 102. The main portion 246 may be folded at line 208 so that portion 216 overlaps a sub-part of main portion 246, where the overlapping portion forms a lip at the top of the packaging device 102. The sheet of material is also folded at line 210 so that portion 214 also overlaps a part of main portion 246, where the portion is located on the inner wall of the packaging device after it has been folded into the teardrop shape. Portions 214, 216 form part of the lip at the base of the packaging device 102. After folding, the edges of top wall 106 meet the entire circumference of the tear-drop shaped wall of spine 104. Adhesive may be applied so that portions 214, 216 are joined to corresponding parts of main portion 246.

Tabs 218 and 220 may be snugly locked or fitted into slots at lines 230, 208, 210, 238 which occur along the edges of the top and/or base of the packaging device 102. The insertion of the tabs into the slots secures the assembled shape of the packaging in part by frictional forces exerted among the tabs and slots.

Lines 212 and 232 which span the diameter of the top wall 106 and bottom wall 108 may be perforated or of a different material than the rest of top 106, such that the top and base may be foldable alone line 232 and 212, respectively. Thus, when pressure is exerted on the sides of the packaging device, the packaging device 102 compresses by being folding along line 232 and 212. Such an approach may prevent the packaging device 102 from bending, folding or crushing along other lines which may cause unsightly damage to the packaging device.

The packaging device 102 may be capable of being folded along lines 232 and 212 such that the packaging device lies entirely flat when folded. The packaging device 102 may be assembled, by bending, tearing and/or joining along various lines as described above, and then folded into a flat shape prior to shipping. Alternatively, the single sheet of material is shipped prior to assembly, and is assembled after arrival.

What is claimed is:

1. A packaging device, comprising:

a top wall formed as an arcuate isosceles triangle;

a bottom wall formed as the arcuate isosceles triangle;

an elongated generally rectangular planar main wall comprising:

a first longitudinal edge joined perpendicularly to the top wall along a first perimeter of the top wall, and a second longitudinal edge joined perpendicularly to the bottom wall along a second perimeter of the bottom wall, wherein the top wall and bottom wall are spaced apart by a length of the main wall;

a first lateral edge joined to a second lateral edge at an acute angle and forming a continuous edge and defining an arcuate spine opposite and spaced apart from the continuous edge;

wherein the top wall, bottom wall, and main wall define an interior cavity.

2. The packaging device recited in claim 1 wherein the main wall further comprises an opening into the interior cavity.

3. The packaging device recited in claim 2 wherein the main wall further comprises a flap covering the opening and extending outwardly from the main wall.

4. The packaging device recited in claim 2 wherein the flap is temporarily affixed to an item in the interior cavity.

5. The packaging device recited in claim 2 wherein the flap comprises two or more perforated edges.

6. The packaging device recited in claim 1 further comprising one or more tabs extending from the first lateral edge and affixed over the second lateral edge.

7. The packaging device recited in claim 1 further comprising one or more upstanding lips extending from one or more of the top wall and the bottom wall.

8. The packaging device recited in claim 1 wherein a height of the main wall in an upright position exceeds a width of the packaging device.

9. The packaging device recited in claim 1 further comprising:

two tabs extending from the first lateral edge and affixed over the second lateral edge;

an opening, in the main wall, into an interior of the packaging device;

a flap, between the two tabs, covering the opening and extending outwardly from the main wall.

10. The packaging device recited in claim 1 comprising a single sheet of material.

11. The packaging device recited in claim 1 comprising a single sheet of paper or cardstock.

12. The packaging device recited in claim 1 comprising one or more bags in the interior cavity.

13. A sheet capable of formation into a packaging device, the sheet comprising:

an elongated generally rectangular planar main wall;

a top wall for the packaging device that is formed as an arcuate isosceles triangle and is formed integrally with a first longitudinal edge of the main wall;

a bottom wall for the packaging device that is formed as the arcuate isosceles triangle and is formed integrally with a second longitudinal edge of the main wall opposite the first longitudinal edge, further comprising a flap extending laterally outwardly from a first lateral edge of the main wall, and a hole in the main wall aligned with the flap and located near a second lateral edge of the main wall that is opposite the first lateral edge.

14. The sheet of claim 13, further comprising:

one or more tabs extending laterally outwardly from a first lateral edge of the main wall;

one or more slots in the main wall, wherein the slots are spaced apart from the tabs, are aligned with the tabs, and are configured to snugly receive the tabs for forming the sheet into the packaging device having an arcuate spine and defining an interior cavity.

15. The sheet of claim 13, wherein the hole is spaced apart from the second lateral edge and is aligned with a fold line defining a continuous edge of the packaging device when the main wall is curved according to an arc such that the flap overlies the hole.

16. The sheet of claim 13, wherein the flap is formed between first and second tabs extending laterally outwardly from a first lateral edge of the main wall; the sheet further comprising one or more slots in the main wall, wherein the slots are spaced apart from the tabs, are aligned with the tabs, and are configured to snugly receive the tabs for forming the sheet into the packaging device having an arcuate spine and defining an interior cavity.

17. A bag packaging device, comprising:

a top wall formed as an arcuate isosceles triangle;

a bottom wall formed as the arcuate isosceles triangle;

an elongated generally rectangular planar main wall comprising:

a first longitudinal edge joined perpendicularly to the top wall along a first perimeter of the top wall, and a second longitudinal edge joined perpendicularly to the bottom wall along a second perimeter of the bottom wall, wherein the top wall and bottom wall are spaced apart by a length of the main wall;

a first lateral edge joined to a second lateral edge at an acute angle and forming a continuous edge and defining an arcuate spine opposite and spaced apart from the continuous edge;

wherein the top wall, bottom wall, and main wall define an interior cavity;

a plurality of bags within the interior cavity.

18. The bag packaging device recited in claim 17 wherein the main wall further comprises an opening into the interior cavity, and a flap covering the opening and extending outwardly from the main wall.

19. The bag packaging device recited in claim 18 wherein the flap is temporarily affixed to one of the bags in the interior cavity.

* * * * *